US006354591B1

(12) United States Patent
d'Agrella

(10) Patent No.: US 6,354,591 B1
(45) Date of Patent: Mar. 12, 2002

(54) PRINTED PRODUCT SLOW DOWN APPARATUS AND METHOD

(75) Inventor: Ingermar S. d'Agrella, Sussex, WI (US)

(73) Assignee: Quad/Tech, Inc., Sussex, WI (US)

( * ) Notice: Subject to any disclaimer, the term of this patent is extended or adjusted under 35 U.S.C. 154(b) by 0 days.

(21) Appl. No.: 09/488,072

(22) Filed: Jan. 19, 2000

(51) Int. Cl.[7] ..... B65H 29/20
(52) U.S. Cl. ..... 271/315; 271/182
(58) Field of Search ..... 271/314, 315, 271/182

(56) References Cited

U.S. PATENT DOCUMENTS

| | | | | |
|---|---|---|---|---|
| 1,949,152 A | * | 2/1934 | Fankboner | 271/315 |
| 4,600,186 A | | 7/1986 | von Hein et al. | |
| 4,712,785 A | * | 12/1987 | Stemmle | 271/315 X |
| 4,717,141 A | * | 1/1988 | Germann | 271/182 X |
| 4,925,173 A | * | 5/1990 | Lindblom et al. | 271/315 X |
| 4,971,303 A | | 11/1990 | Lange et al. | |
| 5,039,082 A | | 8/1991 | Littleton | |
| 5,040,783 A | * | 8/1991 | Ruehl | 271/315 X |
| 5,083,768 A | | 1/1992 | Ertavi et al. | |
| 5,114,135 A | * | 5/1992 | Evangelista et al. | 271/315 X |
| 5,249,791 A | * | 10/1993 | Belanger et al. | 271/315 X |
| 5,452,886 A | | 9/1995 | Cote et al. | |
| 5,485,992 A | | 1/1996 | Albert et al. | |
| 5,630,584 A | | 5/1997 | Seeber | |
| 5,647,586 A | | 7/1997 | Novick et al. | |

FOREIGN PATENT DOCUMENTS

| | | | | |
|---|---|---|---|---|
| DE | 0280087 | * | 6/1990 | 271/315 |
| DE | 0280088 | * | 6/1990 | 271/315 |
| JP | 401069448 | * | 3/1989 | 271/315 |
| JP | 403264457 | * | 11/1991 | 271/315 |

* cited by examiner

*Primary Examiner*—Christopher P. Ellis
*Assistant Examiner*—Patrick Macky
(74) *Attorney, Agent, or Firm*—Michael Best & Friedrich LLP

(57) ABSTRACT

A printed product slow down apparatus and method for slowing down printed products, the apparatus and method utilizing a slow down member to absorb the kinetic energy of the printed product thus slowing down the printed product.

50 Claims, 7 Drawing Sheets

PRINTED PRODUCT SLOW DOWN APPARATUS AND METHOD

FIELD OF THE INVENTION

The invention relates to a printed product slow down apparatus and method for use in a folder of a printing press, and more particularly, to a printed product slow down apparatus and method for slowing down individual printed products by contacting a portion of a printed product that is already in a pocket of a rotating bucket assembly.

BACKGROUND OF THE INVENTION

In the printing industry, an image is repeatedly printed on a continuous web or substrate such as paper. The ink is dried by running the web through curing ovens. In a typical printing process, the web is subsequently slit, typically in the longitudinal direction which is the direction of web movement, to produce a plurality of continuous ribbons. The ribbons are aligned one on top of the other, folded longitudinally, and then cut laterally to produce a plurality of multi-paged, approximately page length web segments, termed signatures. A signature can also be one printed sheet of paper that has or has not been folded.

It is often desirable to transport successive signatures in different directions along various paths in the folder in order to increase the overall operating speed and versatility of the printing process. In general, a sheet diverter operates to route fast moving signatures along a desired one of a plurality of paths as the signatures continue on in the signature processing system. The diverted signatures are transported to one of a plurality of rotating bucket assemblies. The bucket assemblies are operable to transport individual signatures to a conveyor, typically in a shingled orientation. Generally, individual signatures are directed into a pocket of a rotating bucket assembly and, as the bucket assembly rotates, the signatures are removed from the pockets one individual signature after another onto the conveyor in an overlying or shingled orientation.

Printing press systems are operable at high speeds, typically in excess of 2,000–3,000 feet per minute. It is desirable to run printing press equipment at the highest speeds possible in order to produce as many printed products as possible in a given amount of time. Because printing presses operate at high speeds, it is usually necessary to reduce the speed of the signatures at some point in the folder in order to reduce damage to the signatures and to shingle the signatures on the conveyor adjacent the rotating bucket assemblies.

Without signature decelerating equipment, in order to avoid damage to the signatures as the signatures are transferred into the pockets of the rotating bucket assembly, the speed of each signature must be generally slowed down by running the printing press and folder at a slower rate of speed so that the impact force of the leading edge of the signature against the dead end of the pocket is reduced. Thus, without a slow down mechanism, reduced operating speeds limit the overall output of the printing system.

Signature slow down mechanisms often damage the signature they are slowing down. Crumpling of the leading or trailing edges of the signatures can occur if the slow down mechanism is too aggressive in slowing down the signatures.

Signature slow down mechanisms often have problems relating to correctly timing the transfer of the signatures from the slow down step to the entry into the pockets of the rotating bucket assembly. If a signature emerging from a slow down mechanism is not properly aligned with a pocket of the bucket assembly at the appropriate time, the signature will be directed at the bucket assembly in such a way that the signature will not properly enter a pocket which may cause a jam in the overall operation or damage to the signature.

SUMMARY OF THE INVENTION

The invention provides an apparatus and method for slowing down printed products as they travel through a rotating bucket assembly section of a folder of a printing press. The rotating bucket assembly typically including at least two rotatable fan wheels which cooperate to provide a plurality of aligned pockets for receiving individual printed products. The slow down apparatus generally includes an arm and a free wheeling member supported by the arm. The free wheeling member is moveable, such as rotatable, upon contact with a printed product. The free wheeling member is positionable by the arm and relative to the fan wheels such that the free wheeling member contacts a portion of the printed product that is already positioned in a pocket.

An exemplary method of the present invention includes the slowing down of printed products in the folder of a printing press by transporting a printed product to the rotating bucket assembly, transferring the printed product into one of the pockets of the rotating bucket assembly and slowing down the speed of the printed product, after the printed product has begun to enter a pocket, with a non-driven member that rotates upon contact with the printed product.

It is one feature of the present invention to provide an improved printed product slow down apparatus and method.

It is another feature of the present invention to provide a printed product slow down apparatus and method that enables a printing press to be operated at high speeds.

It is another feature of the present invention to provide a printed product slow down apparatus and method that reduces the kinetic energy of a moving printed product thus slowing down the printed product.

It is another feature of the present invention to provide a printed product slow down apparatus and method that includes at least one member to absorb kinetic energy of a moving printed product.

It is another feature of the present invention to provide a printed product slow down apparatus and method that includes a free wheeling member that rotates upon contact with a printed product to absorb the kinetic energy of the moving printed product.

It is another feature of the present invention to provide a printed product slow down apparatus and method that includes a free wheeling brush or free wheeling roller than is rotated by a printed product.

It is another feature of the present invention to provide a printed product slow down apparatus and method that reduces the impact speed of a printed products at the dead end of the pocket.

It is another feature of the present invention to provide a printed product slow down apparatus and method that reduces damage to a printed products as they travel into and out of the bucket assemblies.

It is another feature of the present invention to provide a printed product slow down apparatus and method that reduces damage to a printed products as they are slowed down.

It is another feature of the present invention to provide a printed product slow down apparatus and method that slows down a printed products after the printed products have at least partially entered a pocket.

It is another feature of the present invention to provide a printed product slow down apparatus and method that slows down printed products by contacting a portion of the printed products that is already in the pocket of a bucket assembly.

It is another feature of the present invention to provide a printed product slow down apparatus and method that slows down printed products by contacting only one side of the printed products.

It is another feature of the present invention to provide a printed product slow down apparatus and method that does not contact the entire length of the printed products.

It is another feature of the present invention to provide a printed product slow down apparatus and method in which the slow down apparatus is inoperative when the press operating speed is below a predetermined point.

It is another feature of the present invention to provide a printed product slow down apparatus and method in which the slow down apparatus is moved out of the path of the printed products to avoid any contact between the printed products and the slow down apparatus when the press operating speed is below a predetermined point.

It is another feature of the present invention to provide a printed product slow down apparatus and method wherein printed products are slowed after they have been released from the transportation mechanism that brought the printed products to the rotating bucket assembly.

It is another feature of the present invention to provide a printed product slow down apparatus and method wherein the slow down apparatus is located between adjacent fan wheels.

It is another feature of the present invention to provide a printed product slow down apparatus and method wherein the position of the slow down apparatus relative to the bucket assembly is adjustable.

Other features and advantages of the invention will become apparent to those of ordinary skill in the art upon review of the following detailed description, claims, and drawings.

Figure 1:
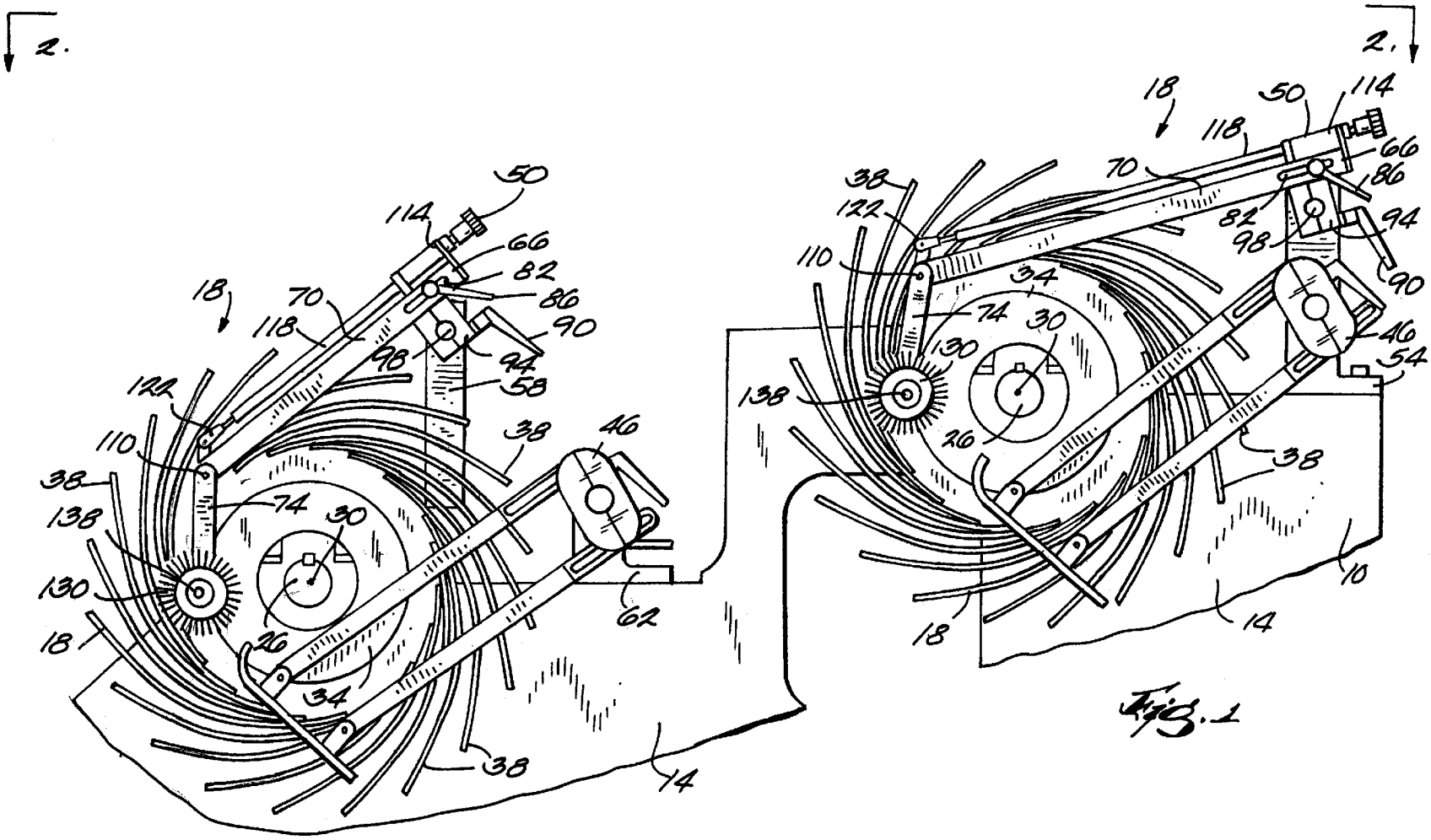
FIG. 1 is a side elevational view of two bucket assemblies with respective printed product slow down apparatuses embodying the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

Figure 2:
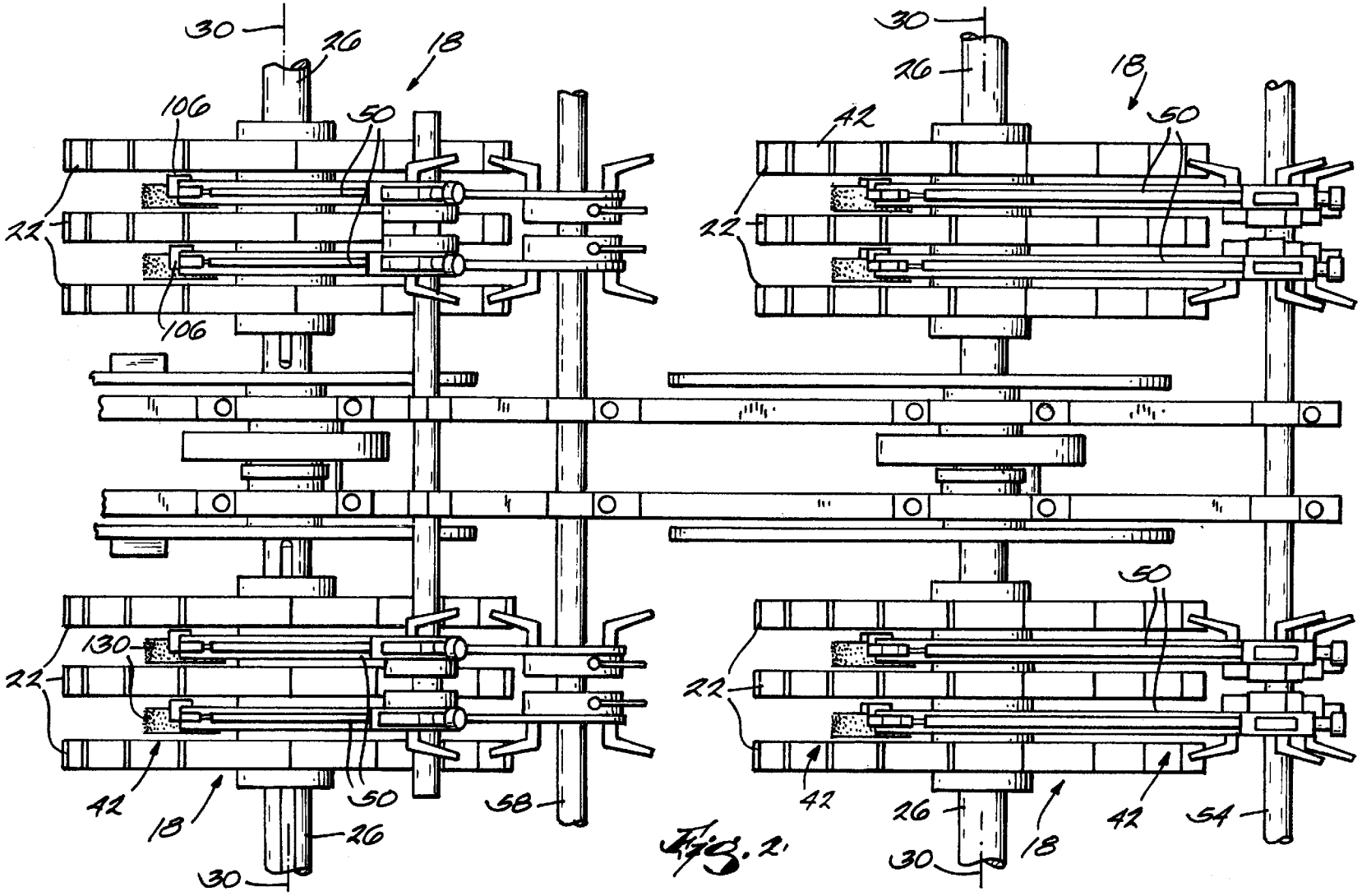
FIG. 2 is a view taken along line 2—2 of FIG. 1.

Referring now to the drawings, there is shown in FIGS. 1 and 2 a portion of a folder 10 of a printing press. The folder 10 includes a frame 14 that supports four conventional rotating bucket assemblies 18 (with only two bucket assemblies being visible in FIG. 1). Each bucket assembly 18 includes a plurality of fan wheels 22 that are spaced axially from one another, with three fan wheels 22 illustrated for each bucket assembly 18 in the embodiment shown in the drawings. However, it should be noted that any number of fan wheels 22 can be utilized with the present invention. The fan wheels 22 of one bucket assembly 18 are shown mounted on a common shaft 26, which defines a rotation axis 30.

Each fan wheel 22 includes a hub 34 and a plurality of blades 38 extending outwardly from the hub 34. The fan wheels 22 of a given bucket assembly 18 and the blades 38 in particular, are aligned such that the blades 38 of all of the fan wheels of one bucket assembly 18 form pockets 42 between the blades 38 for the support of an individual printed product, as is well known in the art. After an individual printed product enters a pocket 42, the bucket assembly 18 rotates and thereafter deposits the individual printed product signature onto a conveyor (not shown in the drawings). A stripping mechanism 46 (FIG. 1) assists in removing the individual printed products from a pocket 42, as is well known in the art.

Printed products can include various types of printed materials such as individual unfolded sheets, signatures and the like. It should be noted that the present invention can be utilized with many differing types of printed products. The following description of the preferred embodiment will refer to signatures, however, this terminology is not meant to be limiting as other types of printed products are contemplated to be slowed down by the present invention.

Continuing to refer to FIGS. 1 and 2, two slow down apparatuses 50 are shown employed with each rotating bucket assembly 18. Preferably, one slow down apparatus 50 is employed between every two fan wheels 22. However, it should be noted that any number and any orientation of slow down apparatuses 50 can be used as desired.

The slow down apparatus 50 is mounted to the frame 14 of the folder 10. FIG. 1 illustrates two different mounting arrangements. As shown in the right most bucket assembly 18 of FIG. 1, a bracket 54 is secured to the frame 14 of the folder 10. The bracket 54 serves to support the slow down apparatus 50 as well as the stripper mechanism 46. As shown in the left most bucket assembly 18 of FIG. 1, a bracket 58 is secured to the frame 14 to support the slow down apparatus 50 and a bracket 62 is secured to the frame 14 to support the stripper mechanism 46. Numerous other mounting arrangements can be employed to support the slow down mechanism 50. As is shown in FIG. 2, the bracket 54 or 58 extends the length of two bucket assemblies 18, however, individual brackets may also be utilized for each slow down apparatus 50.

The slow down apparatus 50 includes an arm 66 having a first segment 70 and a second segment 74. The first segment 70 includes a first end that is supported by the bracket 54 or 58. The first end has therein an oval slot 82. A handle 86, such as a Kipp handle, is positioned in the slot 82 such that the handle 86 is moveable within the slot 82. Tightening of the handle 86 through rotation maintains the orientation of the first segment 70 relative to the bucket assembly 18. Loosening of the handle 86 allows for repositioning of the first segment 70 relative to the bucket assembly 18.

A handle 90, such as Kipp handle, is secured to a mounting plate 94. The mounting plate 94 is pivotable around a bolt 98. The handle 90 is in operational engagement with the plate 94 such that tightening of the handle 90 through rotation maintains the orientation of the first segment 70 relative to the bucket assembly 18 and loosening of the handle 90 allows for repositioning of the first segment 70 relative to the bucket assembly 18.

Accordingly, the handle 86 and the handle 90 allow for a positioning of the arm 66 relative to the bucket assembly 18. Specifically, the handle 86 is used to pivot the arm 66 toward and away from the rotation axis 30 and the handle 90 is used to position the arm 66 with respect to the rotation axis 30. In operation, the folder operator can utilize these two positional adjustments, or degrees of freedom, to optimize the operational position of the slow down apparatus 50.

The second segment 74 of the arm 66 is pivotally secured to a second end of the first segment 70. A handle 106 (FIG. 2), such as a Kipp handle, is operationally connected to a pivot joint 110 to enable the second segment 74 to be adjusted and maintained in a desired position. This third adjustment or degree of freedom to the slow down apparatus 50 enables the second segment 74 to be pivoted toward and away from the rotation axis 30 to further optimally position the slow down apparatus 50 relative to the fan wheels 22.

An air cylinder 114 is supported by the first segment 70 of the arm 66. A rod 118 of the air cylinder 114 is connected to a linkage 122 which in turn is connected to the second segment 74. Actuation of the air cylinder 114 pivots the second segment 74 toward and away from the fan wheels 22. Preferably, the air cylinder 114 is automatically actuated to pivot the second segment 74 away from the fan wheels 18 when the speed of the press is below a predetermined point. When the speed of the press is below a predetermined point, such as 300 fpm, the signatures are not moving fast enough to require slowing down by the apparatus 50. Accordingly, the air cylinder 114 is a means to automatically remove the slow down apparatus 50 from contact with signatures.

Figure 3:
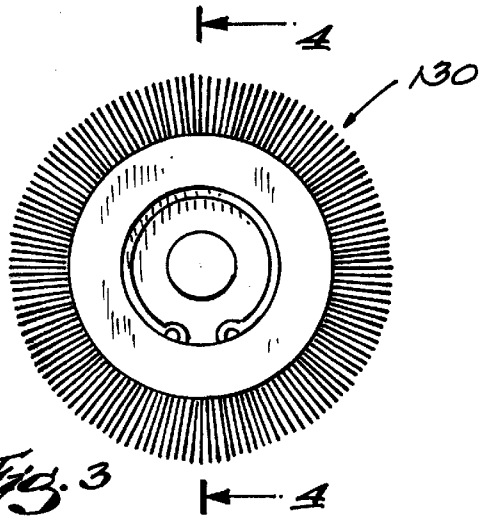
FIG. 3 is a plan view of a brush of the preferred embodiment of the invention.
Figure 4:
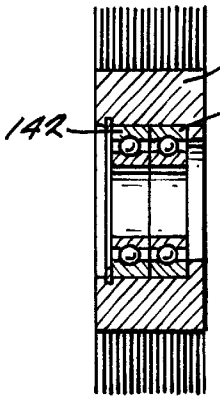
FIG. 4 is a view taken along line 4—4 of FIG. 3.

A slow down member 130 is secured to the end portion of the second segment 74. The member 130 is non-driven or free wheeling. Preferably, the member 130 is secured to the second segment 74 so as to be rotatable. The member 130 is secured to a shaft 138 that is mounted to the second segment 74. With reference to FIGS. 3 and 4, the member 130 is mounted to the shaft 138 via a bearing arrangement, such as the bearings 142. Preferably the member 130 is a brush, such as, for example, model 04062-6 from Tannis of Waukesha, Wis. The types and sizes of brushes to be utilized with the present invention can vary widely. An advantage of using a brush as the slow down member 130 is that ink that may become dislodged from the moving signatures will not accumulate on the brush bristles. The rotational motion of the brush will slough off any ink, therefore extending the operational life of the brush. However, it should be noted that other types of slow down members 130 can be utilized with the present invention. For example, a member such as a steel or alumimum type of roller with an ink resistant coating may be used.

Figure 5A:
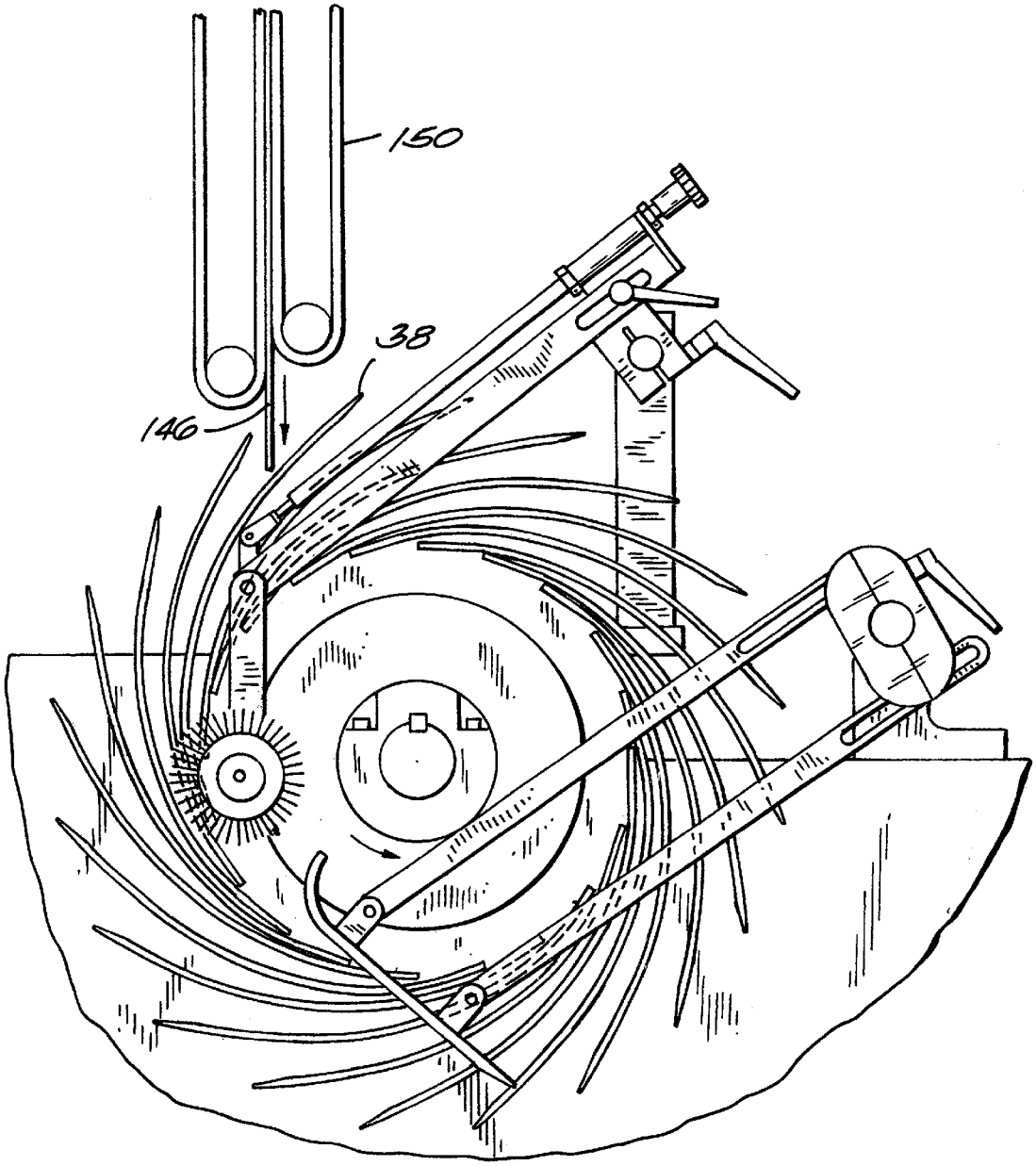
FIGS. 5*a–d* include a time lapse series of side views of portions the slow down apparatus in operation.

The operation of the slow down apparatus 50 will hereafter be described in conjunction with FIGS. 5*a–d.* It should be noted that these figures have portions removed, such as many of the blades 38, for clarity of explanation. Referring to FIG. 5*a,* a signature 146 is shown approaching the bucket assembly 18 from above. At this point, the signature 146 is under the control of a signature delivery or transportation mechanism 150, such as high-speed tapes.

Figure 5B:
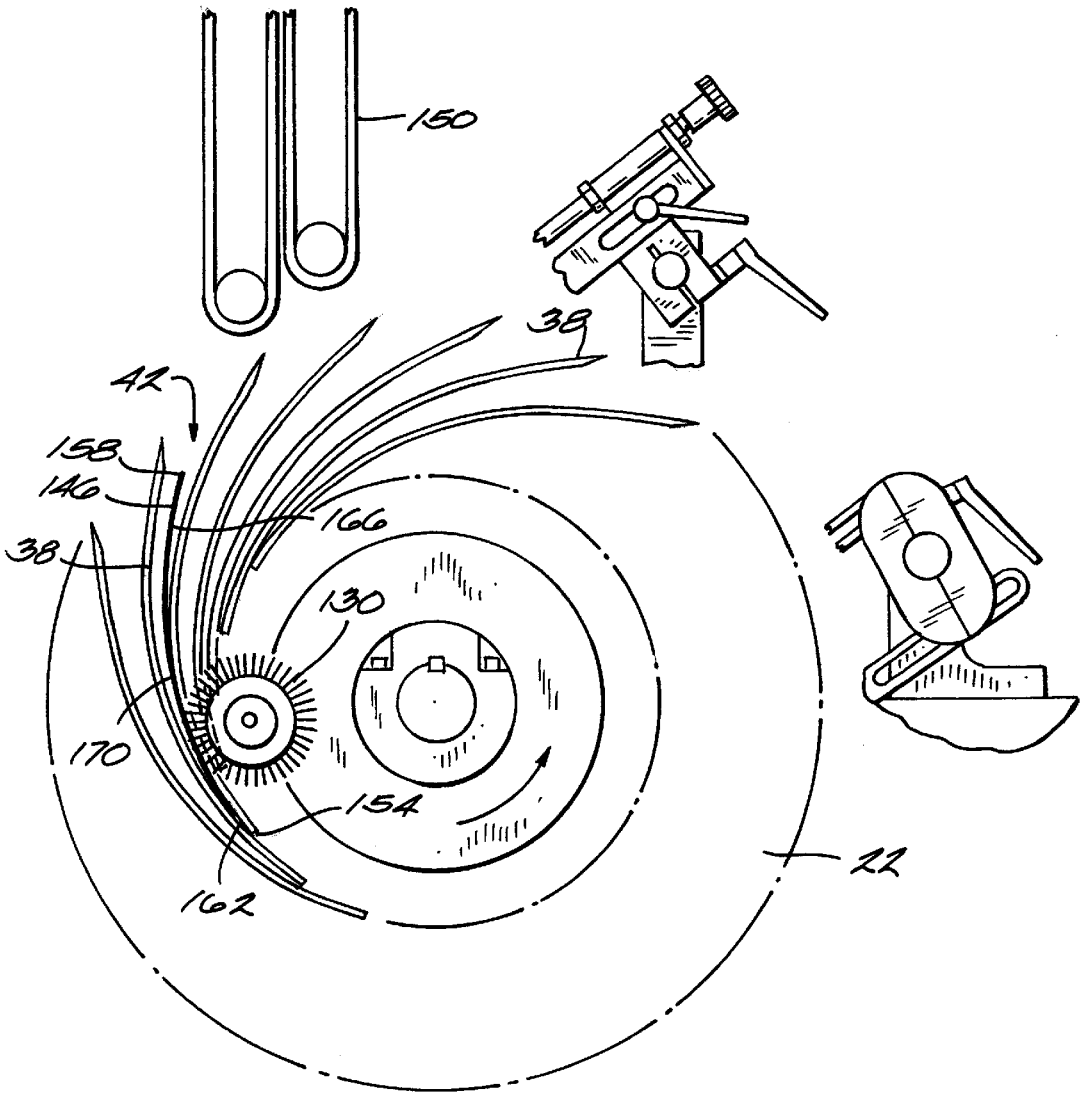

Referring to FIG. 5*b,* the signature 146 enters a pocket 42 and travels in the pocket 42 toward the dead end 154 of the pocket 42 as the fan wheels 22 rotate. Preferably, after the tail 158 of the signature 146 has cleared or been released from the transportation mechanism 150, the leading end 162 of the signature 146 contacts the member 130. This minimizes damage to the signature 146. It is preferred that the contact of the member 130 occur with only one side 166 of the signature 146 and only with a portion 170 of the signature 146 that is already in the pocket 42. By slowing down the signatures when they are already in the pocket, this eliminates the need to correctly time entry of a slowed down signature to the pocket.

It is preferred that there be a gap too small to be shown in the drawings between the member 130 and the blade 38 of the adjacent fan wheel 22. The presence of the gap further minimizes damage to the signature 146 since the signature 146 is not being brought to a complete stop. It is preferred that the signature 146 be slowed while continuing to move in the pocket 42 toward the dead end 154. Contact between the moving signature 146 and the member 130 rotates the free wheeling member 130. Rotation of the member 130 reduces the kinetic energy of the moving signature 146 thus slowing down the signature 146. It is preferred that only a portion of the signature 146, such as 40%, actually comes into contact the member 130.

Figure 5C:
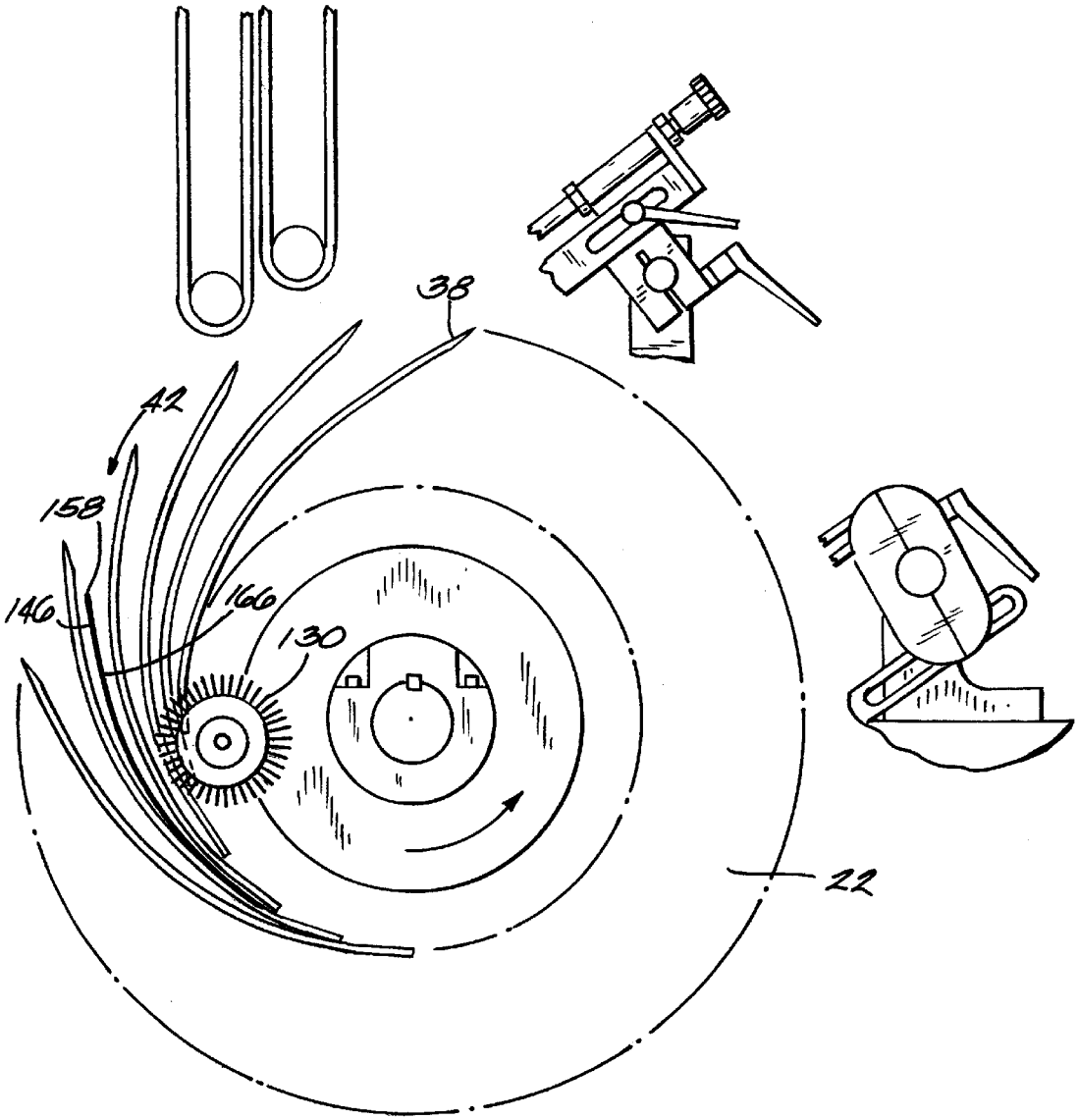
Figure 5D:
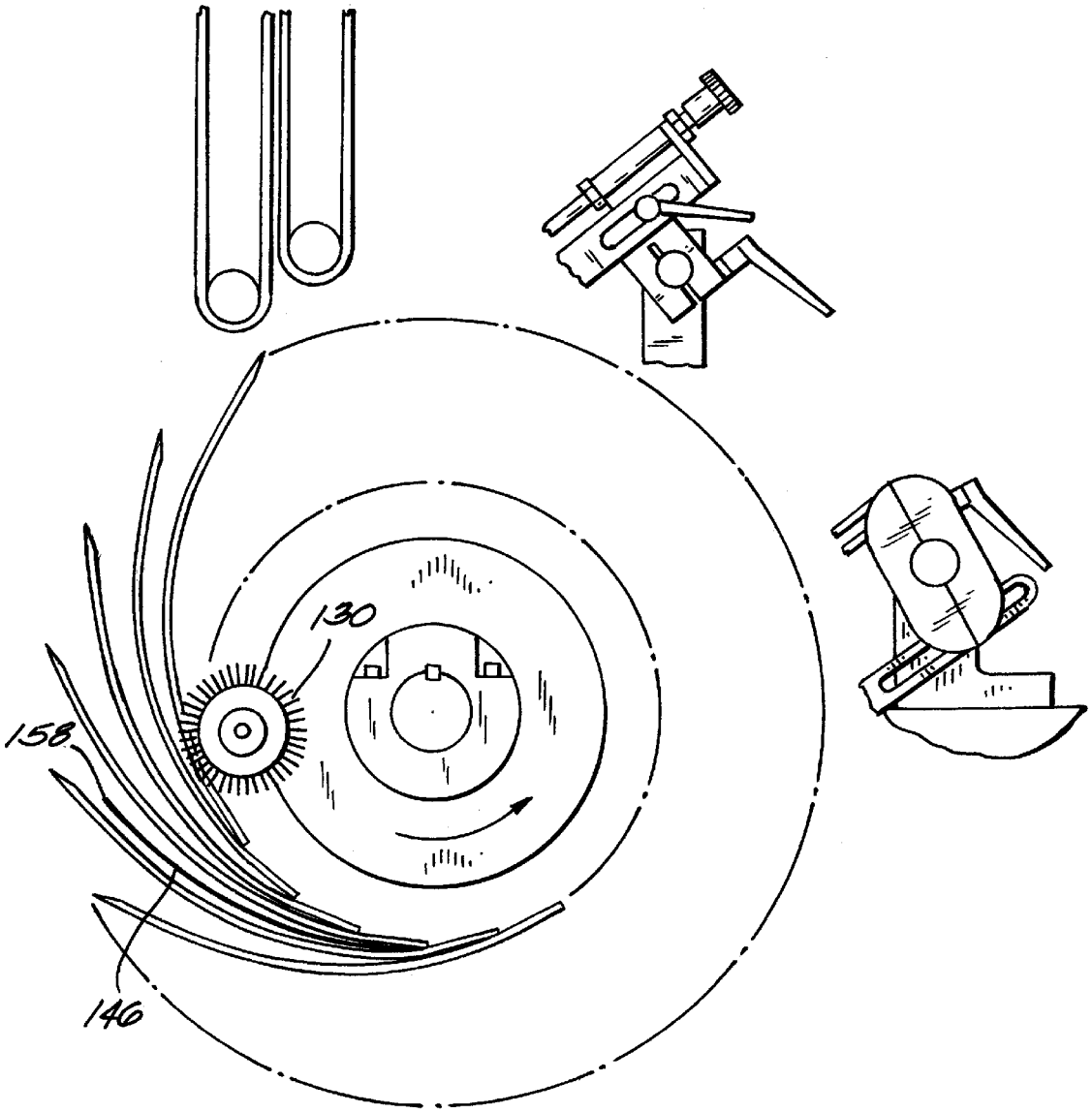

As shown in FIGS. 5*c–d,* the continued rotational motion of the fan wheels 22 moves the signature 146 out of the path of the slow down apparatus 50 therefore not allowing the entire side 166 of the signature 146 to contact the member 130. Further, the member 130 does not have to be either actuated at an appropriate time or moved into and out of contact with the signature 146 on a timed cycle.

Should the printing press be operated below a predetermined speed, the air cylinder 114 can be automatically deployed to retract the member 130 from making contact with signatures 146 that do not need to be slowed down.

To optimally position the slow down apparatus 50, the folder operator positions the apparatus 50 using the handles 86, 90 and 106, as described above. This positioning can be done either during make ready or on the fly during a production run.

Figure 6:
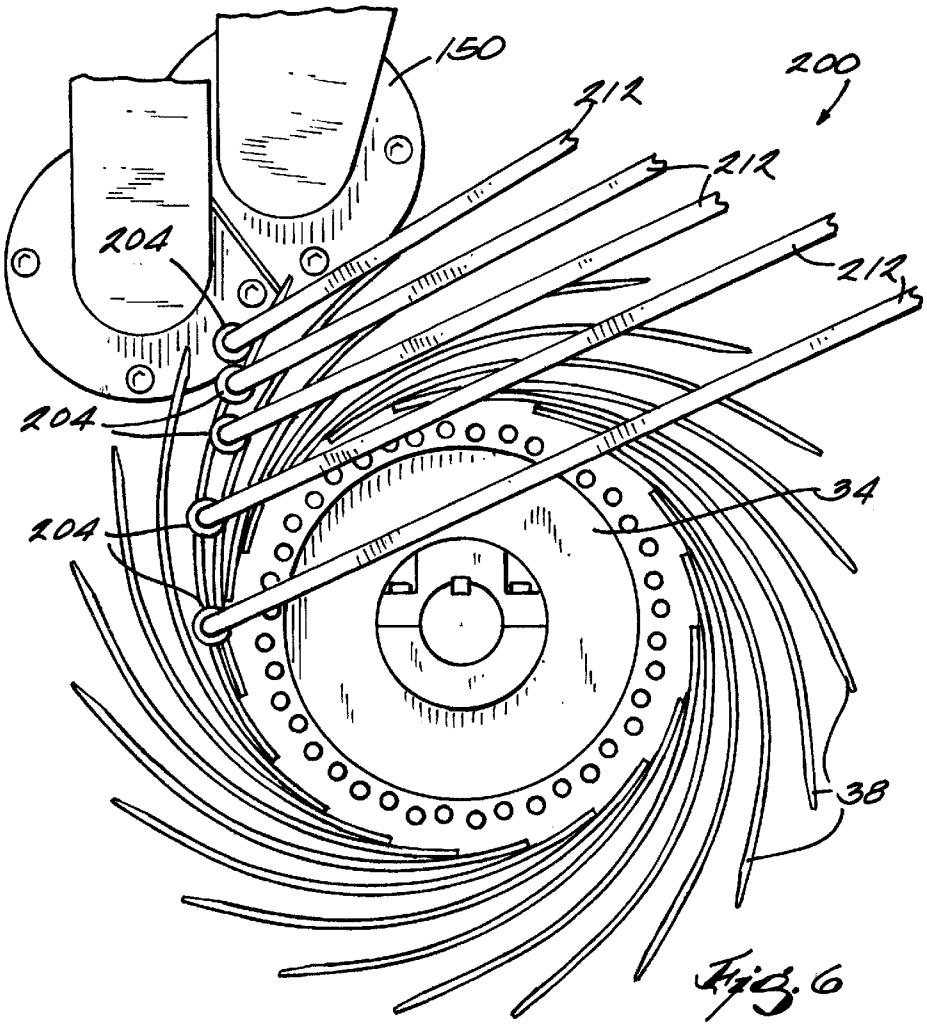
FIG. 6 is a second embodiment of the printed product slow down apparatus embodying the invention.

Referring now to FIG. 6, a second embodiment of the slow down apparatus 200 embodying the invention is shown. The embodiment includes a plurality of non-driven or free wheeling slow down members 204. The members 204 are shown as rollers 208, however, other types of members 204 can be utilized. Each member 204 is mounted to an arm 212, with the arms 212 being adjustable in position to optimally orient the members 204 along the path of the signatures and to work cooperatively together.

In operation of the second embodiment of the slow down apparatus 200, a signature contacts not one as with the first embodiment but a plurality of slow down members 204 along its travel path in a pocket 42. Contact between the moving signatures and the free wheeling members 204 reduces the kinetic energy of the moving signature thus slowing the speed of the signature.

I claim:

1. An apparatus for handling printed products in the folder of a printing press, said apparatus comprising:

a pair of rotatable fan wheels each having a plurality of aligned pockets for receiving individual printed products; and a free wheeling member being rotatable upon contact with a moving printed product and positioned relative to said fan wheels such that said member contacts and slows down the printed product after the printed product has at least begun to enter said pockets.

2. The apparatus of claim 1 wherein said member is positioned to contact the portion of the printed product that is already in said pockets.

3. The apparatus of claim 1 wherein said member is positioned between said fan wheels.

4. The apparatus of claim 1 wherein said member is supported by an arm which is adjustable to position said member relative to said fan wheels.

5. The apparatus of claim 1 wherein said arm includes an air cylinder to adjust the position of said member relative to said fan wheels.

6. The apparatus of claim 1 wherein said arm includes a pivot point to adjust the position of said member relative to said fan wheels.

7. The apparatus of claim 1 wherein said free wheeling member is an annular brush.

8. The apparatus of claim 1 wherein said free wheeling member is a roller.

9. The apparatus of claim 8 wherein said roller includes an ink resistance coating.

10. The apparatus of claim 4 wherein said member is secured to said arm with at least one bearing.

11. An apparatus for handling printed products comprising:

a pair of rotatable fan wheels in spaced relation to one another, each of said fan wheels having a plurality of pockets for receiving individual printed products; and a free wheeling member adapted to rotate upon contact with a moving printed product and to slow down the printed product, said member mounted to an adjustable arm for positioning said member relative to said fan wheels, said arm being operationally separated from said fan wheels such that upon rotation of said fan wheels, said member is selectively removed from contact with the printed product.

12. The apparatus of claim 11 wherein said member is a brush.

13. The apparatus of claim 11 wherein said member is positionable axially between said fan wheels.

14. The apparatus of claim 11 wherein said member is positionable to contact a portion of said printed product that is positioned in said pockets.

15. The apparatus of claim 11 wherein said arm has mounted thereto an air cylinder to adjust the position of said member relative to said fan wheels.

16. The apparatus of claim 11 wherein said arm includes a pivot point to adjust the position of said member relative to said fan wheels.

17. The apparatus of claim 11 wherein said member contacts only a portion of said printed product.

18. A method of slowing down printed products in the folder of a printing press, the folder including a rotating bucket assembly including a plurality of rotating fan wheels having therein aligned pockets, said method comprising the acts:

transporting a printed product to a bucket assembly;

transferring the printed product into the pockets of the rotating fan wheels; and contacting the moving printed product with at least one free wheeling member so that the member rotates to absorb kinetic energy from the moving printed product thereby slowing down the printed product.

19. The method of claim 18 wherein the printed product is a signature.

20. The method of claim 18 wherein in said contacting act, the member is a roller.

21. The method of claim 18 wherein in said contacting act, the member is a brush.

22. The method of claim 18 and further including the act of adjustably positioning the member relative to the bucket.

23. The method of claim 18 wherein in said contacting act, the member is rotatably mounted to an arm with a bearing.

24. The method of claim 18 wherein in said contacting act, the member contacts the printed product after the printed product has begun to enter the pockets.

25. The method of claim 18 wherein in said contacting act, the member contacts the printed product after the printed product has been released from the mechanism that transports the printed product to the bucket assembly.

26. The method of claim 18 and further including the act of positioning the member axially between the fan wheels.

27. The method of claim 18 and further including the act of retracting the member from contact with the printed products if the speed of the printing press is below a predetermined point.

28. A method of slowing down printed products in the folder of a printing press, said method comprising the acts:

transporting a printed product to a rotating bucket assembly having therein pockets for receiving individual printed products;

transferring a printed product into the pockets; and slowing down the speed of the printed product, after the printed product has begun to enter the pockets, with a non-driven member that rotates upon contact with the printed product.

29. The method of claim 28 wherein in said slowing act, the member is a brush.

30. The method of claim 28 wherein in said slowing act, the member is a roller.

31. The method of claim 28 wherein in said slowing act, the member rotates upon contact with a portion of the printed product that has already entered the pockets.

32. The method of claim 28 and further including the act of adjustably positioning the member relative to the bucket assembly.

33. A method of slowing down printed products in the folder of a printing press, said method comprising the acts:

transporting a printed product to a rotating bucket assembly having therein pockets for receiving individual printed products;

transferring the printed product into the pockets;

releasing the printed product from the transporting mechanism; and slowing down the speed of the printed product with a non-driven member that rotates upon contact with the printed product.

34. The method of claim 33 wherein in said slowing act, the member contacts the printed product after the printed product has at least begun to enter the pockets.

35. A method of slowing down printed products in the folder of a printing press, said method comprising the acts:

transporting a printed product to a rotating bucket assembly having therein pockets for receiving individual printed products;

transferring the printed product into the pockets;

slowing down the speed of the printed product, after the printed product has begun to enter the pockets, with a non-driven member that is operationally separated from the bucket assembly and that rotates upon contact with the printed product; and rotating said bucket assembly to selectively remove said member from contact with the printed product.

36. The method of claim 35 and further including the act of releasing the printed product from the transporting mechanism before the act of slowing down the speed of the printed product.

37. The method of claim 35 wherein in said slowing act, a free wheeling member contacts the printed product.

38. The method of claim 37 and further including the act of adjustably positioning the free wheeling member relative to the bucket assembly.

39. The method of claim 35 wherein in said slowing act, a free wheeling brush contacts the printed product.

40. An apparatus for handling printed products having two sides, said apparatus comprising:

a pair of rotatable fan wheels each of said fan wheels having a plurality of aligned pockets for receiving individual printed products; and a non-driven member adapted to contact only one side of a printed product and positioned relative to said fan wheels such that said member contacts a portion of the printed product that is already in said pockets to thereby slow down the speed of the moving printed product.

41. The apparatus of claim 40 wherein said member rotates in response to contact with the printed product.

42. The apparatus of claim 41 wherein said member is a brush.

43. The apparatus of claim 41 wherein said member is a roller.

44. The apparatus of claim 41 and further including an arm onto which said member is mounted and which is moveable to adjustably position said member relative to said fan wheels.

45. The apparatus of claim 44 wherein said arm includes an air cylinder to effectuate the adjustable positioning of said member relative to said fan wheels.

46. A slow down assembly for use in conjunction with a rotating bucket assembly of the folder of a printing press, the rotating bucket assembly including at least two rotatable fan wheels each having a plurality of aligned pockets for receiving individual printed products delivered to the fan wheels by a transport, said slow down assembly comprising:

a moveable arm; and a free wheeling member supported by said arm and rotatable upon contact with a printed product to thereby slow down the speed of the printed product, said member adapted to be positioned by said arm relative to said fan wheels such that said member contacts a portion of the printed product that is positioned in the pockets of the fan wheels, contacts only one side of the printed product, and contacts the printed product after the printed product has been released from the transport.

47. The slow down assembly of claim 46 wherein said member is a brush.

48. The slow down assembly of claim 46 wherein said member is a roller.

49. The slow down assembly of claim 46 wherein said member is rotatable in response to contact by the printed product.

50. The method of claim 28 wherein in said slowing step, said non-driven member contacts only one side of a portion of the printed product that is positioned in said pockets.

* * * * *